US011202357B2

(12) United States Patent
Chung et al.

(10) Patent No.: US 11,202,357 B2
(45) Date of Patent: Dec. 14, 2021

(54) TWO-WIRE DIMMING LIGHTING DEVICE

(71) Applicant: PARAGON SEMICONDUCTOR LIGHTING TECHNOLOGY CO., LTD., New Taipei (TW)

(72) Inventors: Chia-Tin Chung, Miaoli County (TW); Pei-Chun Liu, New Taipei (TW)

(73) Assignee: PARAGON SEMICONDUCTOR LIGHTING TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/920,792

(22) Filed: Jul. 6, 2020

(65) Prior Publication Data

US 2021/0267039 A1 Aug. 26, 2021

(30) Foreign Application Priority Data

Feb. 21, 2020 (TW) ..... 109201924

(51) Int. Cl.

| | |
|---|---|
| ***H05B 47/185*** | (2020.01) |
| ***H05B 45/10*** | (2020.01) |
| ***H05B 45/20*** | (2020.01) |
| ***H05B 47/19*** | (2020.01) |

(52) U.S. Cl.

CPC ..... *H05B 47/185* (2020.01); *H05B 45/10* (2020.01); *H05B 45/20* (2020.01); *H05B 47/19* (2020.01)

(58) Field of Classification Search

CPC ..... H04W 84/12; H04W 4/80; H05B 39/086; H05B 39/088; H05B 47/115; H05B 47/19

See application file for complete search history.

(56) References Cited

U.S. PATENT DOCUMENTS

| | | | | |
|---|---|---|---|---|
| 8,521,035 | B2 * | 8/2013 | Knapp | H04L 12/437 398/172 |
| 2017/0086281 | A1 * | 3/2017 | Avrahamy | B01D 61/147 |
| 2018/0007758 | A1 * | 1/2018 | Rucker | H05B 45/10 |
| 2018/0295796 | A1 * | 10/2018 | Woytowitz | G05F 1/445 |

* cited by examiner

*Primary Examiner* — Monica C King

(74) *Attorney, Agent, or Firm* — Li & Cai Intellectual Property (USA) Office

(57) ABSTRACT

A two-wire dimming lighting device includes an encoding circuit, a decoding circuit, a light source driving circuit, and an LED light emitting circuit. The encoding circuit wirelessly receives the dimming instruction, encodes an AC power according to the dimming instruction, and then outputs an encoded AC power. The decoding circuit receives the encoded AC power and then decodes the encoded AC power to obtain a light source driving instruction. The light source driving circuit receives the light source driving instruction and controls the changes of light emission of the LED light emitting circuit according to the light source driving instruction. The encoding circuit transmits the encoded AC power to the decoding circuit through a two-wire AC transmission wire.

8 Claims, 3 Drawing Sheets

TWO-WIRE DIMMING LIGHTING DEVICE

CROSS-REFERENCE TO RELATED PATENT APPLICATION

This application claims the benefit of priority to Taiwan Patent Application No. 109201924, filed on Feb. 21, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a lighting device, and more particularly to a two-wire dimming lighting device.

BACKGROUND OF THE DISCLOSURE

Conventional LED related lighting devices have already been widely used in daily life. In addition to basic lighting functions, the lighting devices can also adjust brightness or color temperature of light sources, through integrated dimming technology, according to individual requirements. However, when the above dimming technology is applied to a lighting device, the space occupied by the overall size of the circuit component of the lighting device, and the user-friendliness of the control method used for dimming are aspects that must still be considered.

SUMMARY OF THE DISCLOSURE

In response to the above-referenced technical inadequacies, the present disclosure provides a two-wire dimming lighting device, which integrates dimming instructions in a power to simplify the space occupied by the circuit design.

In one aspect, the present disclosure provides a two-wire dimming lighting device that includes an encoding circuit, a decoding circuit, a light source driving circuit, and an LED light emitting circuit. The encoding circuit wirelessly receives the dimming instruction, encodes an alternating current (AC) power according to the dimming instruction, and then outputs an encoded AC power. The decoding circuit, electrically connected to the encoding circuit, receives the encoded AC power and then decodes the encoded AC power to obtain a light source driving instruction. The light source driving device is electrically connected to the decoding circuit and the LED light emitting circuit. The light source driving circuit receives the light source driving instruction and controls the changes of light emission of the LED light emitting circuit according to the light source driving instruction. The encoding circuit transmits the encoded AC power to the decoding circuit through a two-wire AC transmission wire.

In conclusion, the two-wire dimming lighting device provided by the present disclosure transmitting the encoded AC power in the two-wire AC transmission wire can effectively reduce the transmission wire of circuit design, and it is more convenient for users to operate through outputting the dimming instructions through a wireless remote control device.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
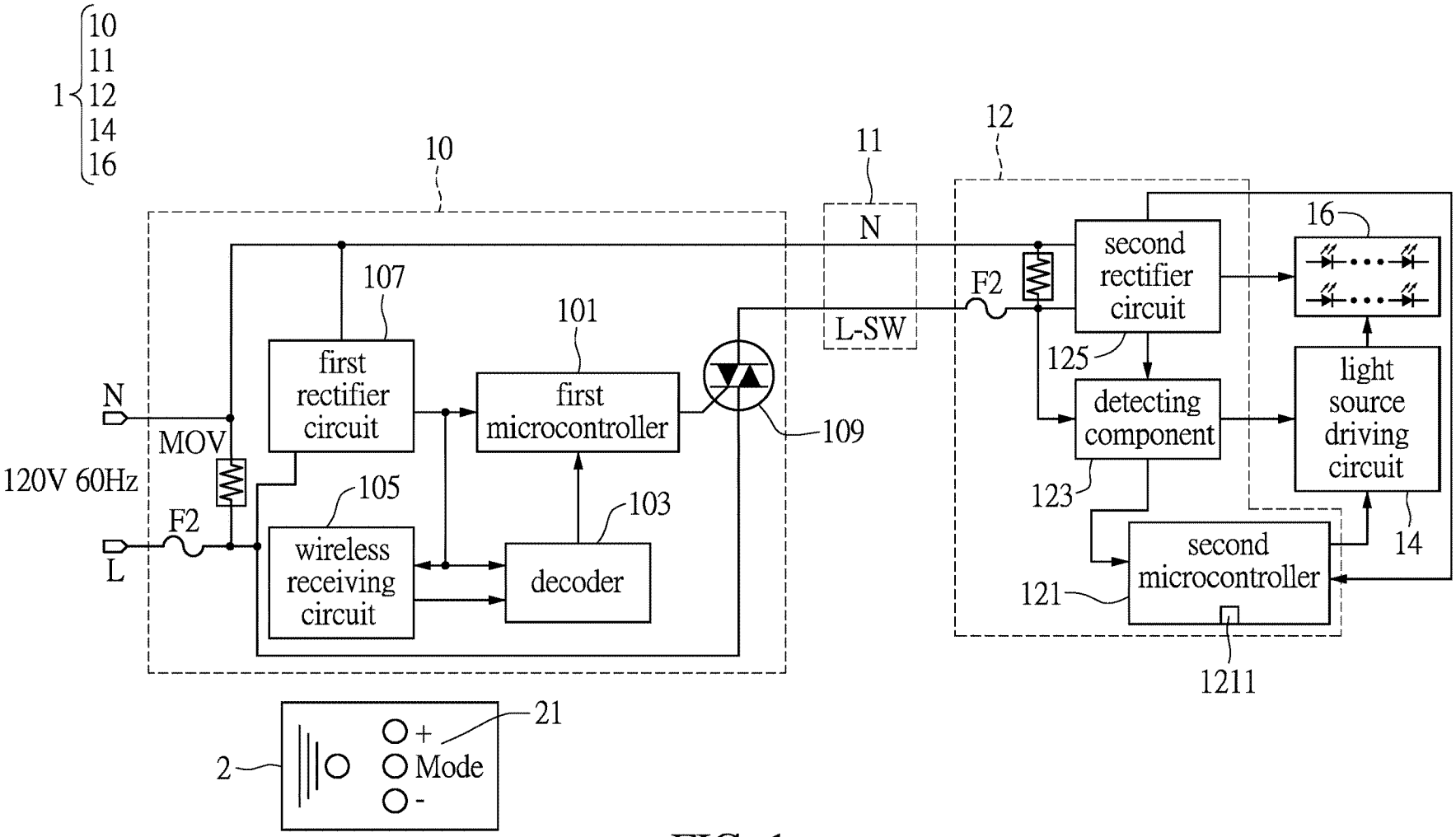
FIG. 1 is a functional block diagram of the two-wire dimming lighting device in one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

A two-wire dimming lighting device is provided in this embodiment. The two-wire dimming lighting device indicates that power and related control instructions are transferred through a two-wire circuit design, which can effectively reduce the usage of wires and occupies less space.

First Embodiment

Referring to FIG. 1, a functional block diagram of the two-wire dimming lighting device in one embodiment of the present disclosure is provided. A lighting device 1 described in this embodiment includes, but is not limited to, for example, an encoding circuit 10, a decoding circuit 12, a light source driving circuit 14, and an LED light emitting circuit 16. The encoding circuit 10 is electrically connected to the decoding circuit 12, the decoding circuit 12 is electrically connected to the light source driving circuit 14, and the light source driving circuit 14 is electrically connected to the LED light emitting circuit 16.

In one embodiment, the encoding circuit 10 is electrically connected to the decoding circuit 12 through an AC transmission line 11, but the present disclosure is not limited thereto. Moreover, after the encoding circuit 10 wirelessly receives a dimming instruction, the encoding circuit 10 encodes an AC power and then outputs an encoded AC power. The specific implementation of the encoding circuit 10 described herein will be exemplified later. The above mentioned dimming instruction is, for example, wirelessly output by a wireless remote control device 2 to the encoding circuit 10 for reception, and the wireless remote control device 2 can be directly operated by users. For example, the users can wirelessly output the dimming instruction to the lighting device 1 through controlling an operation interface 21 on the wireless remote control device 2 for the lighting device 1 to perform different changes of light emission. The operation interface 21 is, for example, a keyboard input interface or a touchscreen input interface, and the present disclosure is not limited thereto. In one embodiment, the decoding circuit 12 is electrically connected to the encoding circuit 10 through the AC transmission line 11. The decoding circuit 12 can, through the AC transmission line 11, not only receive AC power, but also receive the encoded AC power output by the encoding circuit 10, and the decoding circuit 12 can then decode the encoded AC power to obtain a light source driving instruction. The specific implementation of the decoding circuit 12 described herein will be exemplified later.

The light source driving circuit 14 is electrically connected to the decoding circuit 12 and the LED light emitting circuit 16. The light source driving circuit 14 receives the light source driving instruction and controls the changes of light emission of the LED light emitting circuit 16 according to the light source driving instruction.

The LED light emitting circuit 16 includes a plurality groups of LED light strings, and in one embodiment, at least two groups of the plurality groups of LED light strings have different color temperatures which is provided to the light source driving circuit 14 to control the LED light emitting circuit 16 to perform different changes of light emission with different brightness or color temperature according to the light source driving instruction.

For example, when the light source driving circuit 14 is required to control the LED light emitting circuit 16 to emit different brightness, the light source driving circuit 14 can control the plurality groups of LED light strings to emit lights with different brightness through Pulse-Width Modulation (PWM) dimming technology. In other words, when the light source driving circuit 14 is required to control the LED light emitting circuit 16 to emit different brightness, the light source driving circuit 14 can also control the number of light strings of the plurality groups of LED light strings that is turned on, so as to emit lights with different brightness.

In addition, the following assumptions are made in the method of controlling the color temperature: a first group of LED light strings of the plurality groups of LED light strings have a first color temperature, and a second group of LED light strings of the plurality groups of LED light strings have a second color temperature.

When controlling the LED light emitting circuit 16 to emit the first color temperature, the light source driving circuit 14 controls only the first group of LED light strings to turn on and emit light having the first color temperature, and the light source driving circuit 14 simultaneously controls the second group of LED light strings not to turn on and emit light.

When controlling the LED light emitting circuit 16 to emit the second color temperature, the light source driving circuit 14 controls only the second group of LED light strings to turn on and emit light having the first color temperature, and the light source driving circuit 14 simultaneously controls the first group of LED light strings not to turn on and emit light.

When controlling the LED light emitting circuit 16 to emit other color temperatures, the light source driving circuit 14 controls the first and the second group of LED light strings to turn on and emit, so that the first color temperature of the first group of LED light strings and the second color temperature of the second group of LED light strings can be mixed to produce other changes of the color temperature.

It should be noted that, the specific circuit structure and the driving principle of the above mentioned light source driving circuit 14 are ordinary skills in the art of the present disclosure, and will not be reiterated therein. In addition, light emission methods related to the LED light emitting circuit 16 are not limited to the above mentioned examples, a variety of other kinds of light emission methods can be achieved through controlling the light source driving circuit 14 according to practical requirements.

Specifically speaking, the encoding circuit 10 includes, but is not limited to, for example, a first microcontroller 101, a decoder 103, a wireless receiving circuit 105, a first rectifier circuit 107 and a switch component 109. The first rectifier circuit 107 is electrically connected to the first microcontroller 101, the decoder 103 and the wireless receiving circuit 105. The first microcontroller 101 is electrically connected to the decoder 103 and the switch component 109, and the decoder 103 is electrically connected to the wireless receiving circuit 105.

One end of the first rectifier circuit 107 is electrically connected to an AC power transmission line to receive an AC power input, and then rectifies the AC power to output a direct current (DC) power that is provided to the first microcontroller 101, the decoder 103 and the wireless receiving circuit 105 as working power.

The first microcontroller 101 is the control core of the encoding circuit 10. For example, when the wireless receiving circuit 105 receives the dimming instruction from the wireless remote control device 2, the wireless receiving circuit 105 outputs the dimming instruction to the decoder 103. Then, when the decoder 103 receives the dimming instruction, the decoder 103 decodes the dimming instruction into a decoded signal through a decoding method and outputs the decoded signal to the first microcontroller 101.

After the first microcontroller 101 receives the decoding signal, the first microcontroller 101 then encodes the AC power to output the encoded AC power. The encoding method described herein is, for example, adjusting the waveform of the AC power, so that the adjusted AC power becomes the encoded AC power. Since the waveform of the encoded AC power is not the same as the waveform of the original AC power, the decoding circuit 12 can recognize the encoded AC power and the AC power according to their waveform.

In one embodiment, the first microcontroller 101 encodes the waveform of the AC power in the AC transmission line 11 through the switch component 109. For example, the switch component 109 is electrically connected to one end of the AC transmission line 11. When the switch component 109 is turned on, the AC power in the AC transmission line 11 can be transmitted, and when the switch component 109 is not turned on, the AC power in the AC transmission line 11 cannot be transmitted. Thus, the first microcontroller 101 is able to control the time of the switch component 109 being turned on or not and change the waveform of the AC power, through the above mentioned method of controlling the switch component 109.

Figure 2:
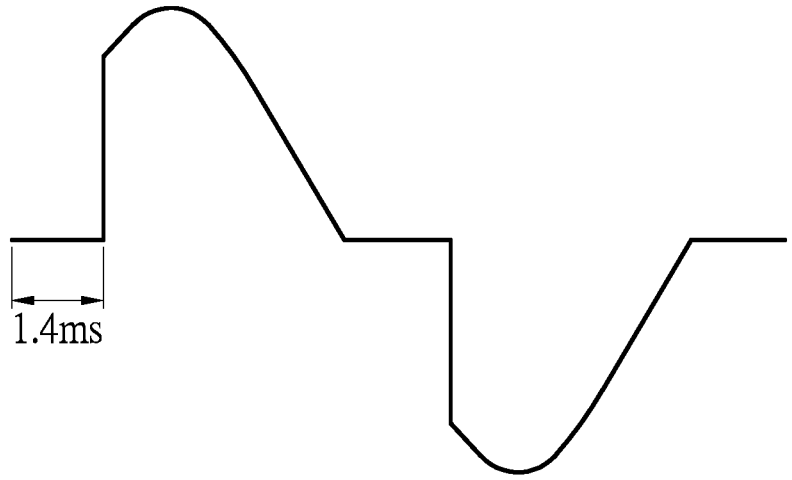
FIG. 2 is a waveform of the encoded AC power in one embodiment of the present disclosure.

In one embodiment, the waveform of the encoded AC power can be shown in FIG. 2. As shown in FIG. 2, the waveform of the encoded AC power is obtained by phase cutting a first zero-crossing time (such as 1.4 ms) for the positive half cycle and the negative half cycle of the AC power. Furthermore, the above mentioned phase cutting of the first zero-crossing time (such as 1.4 ms) indicates that the first microcontroller 101 controls the switch component 109 to be turned off, for a period of the first zero-crossing time (such as 1.4 ms) at the beginning of each of the positive half cycle and the negative half cycle, and then the controls the switch component 109 to be turned on.

Figure 3:
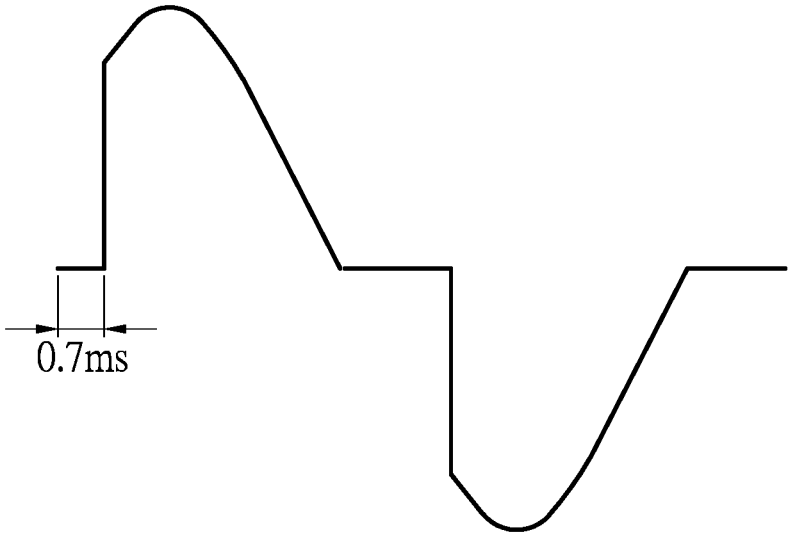
FIG. 3 is another waveform of the encoded AC power in one embodiment of the present disclosure.

In another embodiment, the waveform of the encoded AC power can be shown in FIG. 3. As shown in FIG. 3, the waveform of the encoded AC power is obtained by phase cutting a second zero-crossing time (such as 0.7 ms) for the positive half cycle and the negative half cycle of the AC power. Furthermore, the above mentioned phase cutting of the second zero-crossing time (such as 0.7 ms) indicates that the first microcontroller 101 controls the switch component 109 to be turned off for a period of the second zero-crossing time (such as 0.7 ms) at the beginning of each of the positive half cycle and the negative half cycle, and then controls the switch component 109 to be turned on.

Thus, in this embodiment, the encoded AC power as shown in FIG. 2 can be regarded as bit "0", and the encoded AC power as shown in FIG. 3 can be regarded as bit "1", but the present disclosure is not limited thereto. As shown in FIG. 2 and FIG. 3, the zero-crossing time can also be adjusted flexibly according to requirements. In addition to the forward phase control (FPC) technique shown in FIG. 2 and FIG. 3, the starting point of the zero-crossing time can also be operated with the reverse phase control (RPC) according to requirements.

Therefore, after the first microcontroller 101 receives the decoding signal, the first microcontroller 101 is then able to control the switch component 109 correspondingly, according to a command code corresponding to the decoding signal, and produce the corresponding encoded AC power.

For example, the decoding signal can be the command code, and the command code can be, for example, an 8-bit dimming command code, where the first bit is a starting bit and the other 7 bits are command bits. In one embodiment, the dimming command code can be C8H which represents that the dimming level is at 100%, the dimming command code can be C4H which represents that the dimming level is at 98%, the dimming command code can be C0H which represents that the dimming level is at 96%, and so forth. The above mentioned compositions of the dimming command codes and the coding are merely examples, and the present disclosure is not limited thereto.

Therefore, when the first microcontroller 101 receives the decoding signal corresponding to the C4H dimming command code, the first microcontroller 101 sequentially controls the switch component 109 to encode the AC power according to the bit-encoding method as shown in FIG. 2 and FIG. 3, according to the 11000100 bit-encoding method of C4H. For example, when the bit is 0, the first microcontroller 101 controls the switch component 109 to encode the AC power, so that the AC power is the encoded AC power shown in FIG. 2, and when the bit is 1, the first microcontroller 101 controls the switch component 109 to encode the AC power, so that the AC power is the encoded AC power shown in FIG. 3.

For another example, the decoding signal can be a color temperature command code, and the color temperature command code can be, for example, an 8-bit color temperature command code, where the first bit is a starting bit and the other 7 bits are command bits. In one embodiment, the color temperature command code can be FCH which represents that the color temperature is at 3000K, the color temperature command code can be FEH which represents that the color temperature is at 3000K+6000K, the color temperature command code can be FAH which represents that the color temperature is at 6000K, and etc. The above mentioned compositions of the color temperature command codes and the coding are merely examples, and the present disclosure is not limited thereto.

Therefore, when the first microcontroller 101 receives the decoding signal corresponding to the FCH color temperature command code, the first microcontroller 101 sequentially controls the switch component 109 to encode the AC power according to the bit-encoding method as shown in FIG. 2 and FIG. 3, according to the 11000100 bit-encoding method of FCH. For example, when the bit is 0, the first microcontroller 101 controls the switch component 109 to encode the AC power, so that the AC power is the encoded AC power shown in FIG. 2, and when the bit is 1, the first microcontroller 101 controls the switch component 109 to encode the AC power, so that the AC power is the encoded AC power shown in FIG. 3.

Furthermore, it should be noted that between the above mentioned command code and the next command code, a preset number, e.g., 4, of AC power with a fully-conducted phase angle, i.e., sine wave, is required to ensure that the encoded AC power can be accurately received and recognized by the decoding circuit 12, and effectively avoid misinterpretation.

The above mentioned switch component 109 in FIG. 1 is, for example, a tri-electrode AC switch (TRIAC), and the present disclosure is not limited thereto.

In one embodiment, the decoding circuit 12 includes, but is not limited to, for example, a second microcontroller 121, a detecting component 123, and a second rectifier circuit 125. The second microcontroller 121 is electrically connected to the detecting component 123, the light source driving circuit 14, and the second rectifier circuit 125. One end of the second rectifier circuit 125 is electrically connected to an AC transmission line 11 to receive the AC power, and then rectifies the AC power to output the DC power that is provided to the second microcontroller 121, the LED light emitting circuit 16, and the detecting component 123 as working power.

The second microcontroller 121 recognizes whether or not the power transmitted in the AC transmission line 11 is the encoded AC power through the detecting component 123. When the detecting component 123 recognizes that the power transmitted in the AC transmission line 11 is the encoded AC power, the detecting component 123 outputs a detecting result to the second microcontroller 121 for an interpretation. The second microcontroller 121 then determines whether the detecting result has a corresponding light source driving instruction through a dimming comparison table or not, and when the detecting result has a corresponding light source driving instruction, the second microcontroller 121 outputs the light source driving instruction to the light source driving circuit 14. Therefore, the light source driving circuit 14 is able to correspondingly control the changes of light emission of the LED light emitting circuit 16 according to the received light source driving instruction. The light source driving instruction can be, for example, the related brightness or color temperature control instructions that controls the LED light emitting circuit 16.

Moreover, the detecting component 123 is, for example, a phase detecting component. The phase detecting component can detect whether the power transmitted in the AC transmission line 11 is an unencoded AC power or an encoded AC power. The unencoded AC power refers to an AC power with a fully-conducted phase angle, and the encoded AC power is an AC power with a non-fully-conducted phase angle. Thus, the phase angle detecting component is able to determine whether the power transmitted in the AC transmission line 11 is the unencoded AC power or the encoded AC power through the phase angle change of the power transmitted in the AC transmission line 11.

Furthermore, the second microcontroller 121 can recognize whether or not the power transmitted in the AC transmission line 11 is the encoded AC power according to the detecting result of the detecting component 123. For example, when the second microcontroller 121 recognizes that the power transmitted in the AC transmission line 11 is the encoded AC power through the detecting component 123, the second microcontroller 121 conducts an interpretation of the bit of the encoded AC power received by the decoding circuit 12. For example, when the second microcontroller 121 recognizes that the encoded AC power received by the decoding circuit 12, for example, corresponds to the waveform as shown in FIG. 2, the second microcontroller 121 determines that the encoded AC power represents bit 0. In addition, when the second microcontroller 121 recognizes that the encoded AC power received by the decoding circuit 12, for example, corresponds to the waveform as shown in FIG. 3, the second microcontroller 121 determines that the encoded AC power represents bit 1.

In one embodiment, the second microcontroller 121 sequentially receives a certain amount of the encoded AC powers, and then compares the certain amount of the encoded AC power with the preset data in the dimming comparison table to determine whether there is a corresponding light source driving instruction.

Specifically speaking, the dimming comparison table has multiple groups of light source driving instructions, and each of the light source driving instructions has corresponding preset decoding bytes. For example, a group of light source driving instruction of the dimming comparison table can be a first color temperature light source driving instruction that has a corresponding preset "11111100" decoding bytes. When the second microcontroller 121 sequentially receives the multiple groups of the encoded AC powers that, after being sequentially recognized, represent the "11111100" bytes, the second microcontroller 121 then outputs the first color temperature light source driving instruction to the light source driving circuit 14. Thus, when the light source driving circuit 14 receives the first color temperature light source driving instruction, the light source driving circuit 14 can then control the LED light emitting circuit 16 to emit light with the first color temperature accordingly.

The above mentioned first microcontroller 101 and the second microcontroller 121 can each be, for example, one or any combination of an application specific integrated circuit (ASIC), a field programmable gate array (FPGA), or a system on a chip (SoC), and the present disclosure is not limited thereto. The above mentioned first microcontroller 101 and decoder 103 can be integrated into a system on a chip (SoC). The above mentioned dimming comparison table is stored, for example, in a storage component 1211 of the second microcontroller 121. Moreover, in one embodiment, the storage component 1211 is able to store the last light source driving instruction that is output to the light source driving circuit 14 by the second microcontroller 121. When the lighting device 1 is restarted for usage, the last light source driving instruction that is stored in the storage component 1211 is able to drive the LED light emitting circuit 16. The above mentioned storage component 1211 is, for example, a non-volatile memory.

Figure 4:
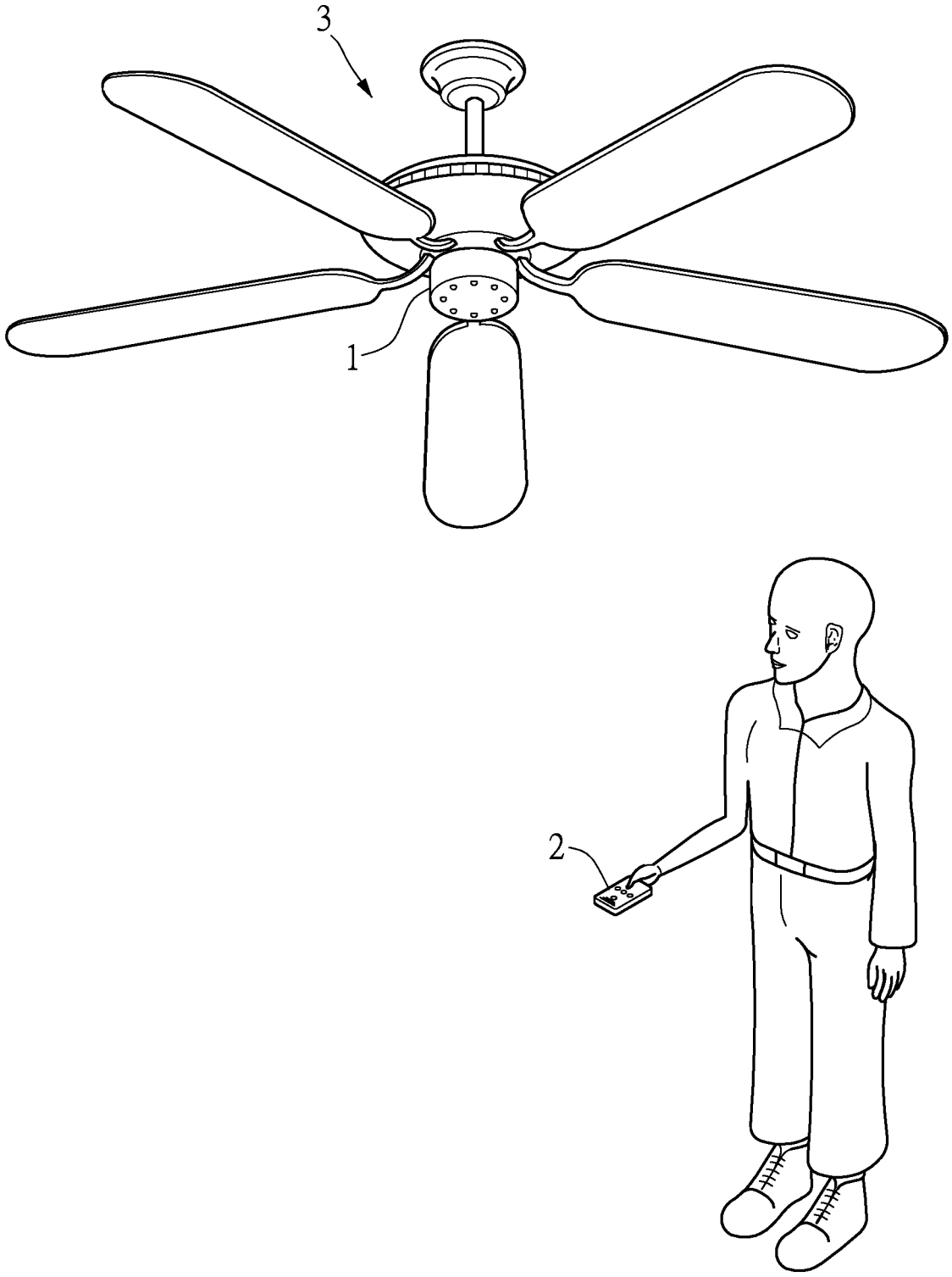
FIG. 4 is an application schematic view of the two-wire dimming lighting device in one embodiment of the present disclosure.

Referring to FIG. 4, an application schematic view of the two-wire dimming lighting device in one embodiment of the present disclosure is provided. In a usage example, the lighting device 1 provided in this embodiment can be applied to a ceiling fan light 3, and users can hold a wireless remote control device 2 to wirelessly control the changes of light emission of the ceiling fan light 3. On one hand, since the lighting device 1 can effectively reduce the number of wires through the two-wire dimming technology, the lighting device 1 can be effectively integrated in the ceiling fan light 3 and used without occupying space. On the other hand, when users control the variety of the changes of light emission of the ceiling fan light 3 with a wireless remote control device 2, the power of the ceiling fan light 3 is not required to be cut off, and the wireless remote control device 2 can directly output dimming instructions to the lighting device of the ceiling fan light 3 to switch between different light sources to emit light.

One of the advantages of the present disclosure is that the two-wire dimming lighting device integrates the normal AC power and the encoded AC power to be transmitted in the two-wire AC transmission line. In addition to the original effect of power transmission, the AC transmission line is also able to transmit instructions related to light-dimming, which can effectively reduce the quantity of the transmission lines in circuit design. Moreover, directly transmitting the dimming instruction to the lighting device through a wireless remote control device also increases the convenience of usage for the users.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A two-wire dimming lighting device, comprising:

an encoding circuit, receiving an alternating current (AC) power with a fully-conducted phase angle, wherein the encoding circuit includes a first microcontroller and a switch component, the first microcontroller is electrically connected to the switch component, the first microcontroller sequentially controls the switch component to encode the AC power to generate an encoded AC power according to a dimming command code, and the encoded AC power is the AC power with a non-fully-conducted phase angle;

wherein, when a bit of the dimming command code is 0, the first microcontroller controls the switch component to be turned off for a period of a first zero-crossing time, and a waveform of the encoded AC power is obtained by phase cutting the first zero-crossing time for a positive half cycle of the AC power and a negative half cycle of the AC power;

wherein, when the bit of the dimming command code is 1, the first microcontroller controls the switch component to be turned off for a period of a second zero-crossing time, the period of the second zero-crossing time is different from the period of the first zero-crossing time, and the waveform of the encoded AC power is obtained by phase cutting the second zero-crossing time for the positive half cycle of the AC power and the negative half cycle of the AC power;

a decoding circuit, electrically connected to the encoding circuit through an AC transmission wire, wherein the decoding circuit includes a second microcontroller and a detecting component electrically connected to the second microcontroller, the second microcontroller recognizes whether a power transmitted in the AC transmission line is the encoded AC power according to a detection result of the detecting component, the second microcontroller conducts an interpretation of the bit of the encoded AC power when the power transmitted in the AC transmission line is the encoded AC power and outputs a light source driving instruction according to the interpretation of the bit of the encoded AC power;

an LED light emitting circuit; and a light source driving circuit, electrically connected to the second microcontroller and the LED light emitting circuit, wherein the light source driving circuit receives the light source driving instruction, and controls the changes of light emission of the LED light emitting circuit according to the light source driving instruction.

2. The two-wire dimming lighting device according to claim 1, wherein the switch component is a tri-electrode AC switch.

3. The two-wire dimming lighting device according to claim 2, wherein the encoding circuit further includes:

a wireless receiving circuit, wirelessly receiving the light dimming instruction; and a decoder, electrically connected to the wireless receiving circuit, decoding the light dimming instruction, and outputting a decoding signal to the first micro controller;

wherein the first microcontroller controls the switch component according to the decoding signal.

4. The two-wire dimming lighting device according to claim 3, wherein the encoding circuit further includes:

a first rectifier circuit, electrically connected to the first microcontroller, the decoder, and the wireless receiving circuit, wherein the first rectifier circuit rectifies the AC power to output a direct current (DC) power supplying the first microcontroller, the decoder, and the wireless receiving circuit.

5. The two-wire dimming lighting device according to claim 4, wherein the LED light emitting circuit includes a plurality of LED light strings, and at least two of the plurality of LED light strings have different color temperatures, and the light source driving circuit controls the LED light emitting circuit to emit different brightness or color temperatures according to the light source driving instruction.

6. The two-wire dimming lighting device according to claim 1, wherein the detecting component is a phase detecting component.

7. The two-wire dimming lighting device according to claim 1, wherein the second microcontroller has a storage component, the storage component stores a dimming comparison table, and the second microcontroller finds the light source driving instruction, corresponding to the detection result of the detecting component, from the dimming comparison table.

8. The two-wire dimming lighting device according to claim 1, wherein a preset number of the AC power with the fully-conducted phase angle is between a command code and a next command code to ensure that the encoded AC power is received and recognized by the decoding circuit.

* * * * *